United States Patent [19]

Shell

[11] Patent Number: 4,968,171

[45] Date of Patent: Nov. 6, 1990

[54] HINGELESS ASSEMBLY FOR A DISPLAY SYSTEM

[75] Inventor: Irving W. Shell, Pompano Beach, Fla.

[73] Assignee: Friedkin Industries, Inc., Boca Raton, Fla.

[21] Appl. No.: 301,725

[22] Filed: Jan. 26, 1989

[51] Int. Cl.[5] ..... E04B 1/343

[52] U.S. Cl. ..... 403/4; 403/387; 160/135; 160/351; 52/282; 52/285

[58] Field of Search ..... 403/4, 340, 331, 364, 403/387; 256/26, 25; 160/351, 135; 52/70, 285, 282

[56] References Cited

U.S. PATENT DOCUMENTS

| | | | |
|---|---|---|---|
| 3,585,768 | 6/1971 | Klein | 52/282 X |
| 4,155,664 | 5/1979 | Acheson | 403/331 X |
| 4,344,475 | 8/1982 | Frey | 160/351 X |
| 4,436,135 | 3/1984 | Ytter | 160/135 |
| 4,594,829 | 6/1986 | Herrgard | 52/285 |
| 4,785,565 | 11/1988 | Kuffner | 160/135 X |

OTHER PUBLICATIONS

Sales brochure Multiscreen® by Exposystems®, 3/1988.

*Primary Examiner*—Peter M. Cuomo
*Attorney, Agent, or Firm*—Richard M. Saccocio

[57] ABSTRACT

A hingeless assembly for a modular display panel system is disclosed. The hingeless assembly includes a first portion which allows for attachment thereto of a flat plate wall panel and a second section for attaching an adjacent hingeless assembly thereto. The hingeless assembly of the present invention may be joined to another hingeless assembly with an angle of from zero to ninety degrees therebetween so as to form a display panel system of virtually any shape conceivable. The hingeless assembly attachment portion comprises an extending circular member and an extending parallel arranged cup-like member. The attachment portion of the hingeless assembly allows for connection thereto of another hingeless assembly with the cup-like and circular members of one of the assemblies respectively fitting with the circular member and the cup-like member of the other assembly so as to form a rotatable angle therebetween.

10 Claims, 1 Drawing Sheet

HINGELESS ASSEMBLY FOR A DISPLAY SYSTEM

BACKGROUND OF THE INVENTION

1. Field of the Invention

This invention pertains in general to the field of portable, self-standing, modular display systems and in particular to the field of a hingeless extrusion which may be combined with other hingeless extrusions to form a multiple positionable modular display system.

2. Description of the Prior Art

Portable, self-standing, modular display systems include vertical posts separated by a flat panel and wherein additional flat panels and vertical posts may be joined thereto to form a display arrangement whereby a vendor of goods, services, informational display services, or the like may advertise their goods or services on the flat plate sections. Such display systems are usually temporarily arranged and set up for non-fixed and non-permanent use such as for trade shows and other similar events. Further, such display systems may combine a number of different flat panels arranged at various angles to each other to result in a temporary display system which can be arranged into a large number of geometric configurations. It is further advantageous that these systems be easily assembled and taken apart and easily arranged into the different configurations but yet such that a relatively rigid structure which is free standing may be obtained.

To the above end, the prior art includes a number of differently shaped extrusions in combination with hinges which serve as the vertical posts of a modular display system. Moreover, the shapes of these vertical posts and hinges include provision for mounting between vertical posts a flat display panel which is used to display product information or services. In order to achieve all of the above objectives, the prior art vertical upright posts and hinges have complicated cross-sectional configurations and/or are used with other devices to achieve a free-standing display system which may be arranged into a large number of geometric configurations.

Accordingly, it is an object of the present invention to provide a hingeless assembly for use with a modular display system which is easy to assembly and disassemble and yet provide a rigid, non-permanent arrangement.

Another object of the present invention is to provide a hingeless assembly for a modular display system which allows for a large number of display arrangement configurations.

Yet another object of the present invention is to provide a hingeless assembly for a modular display system which requires only one cross-sectional shape for the vertical uprights of a display system and which allows for assembly to other vertical upright posts without any additional components.

SUMMARY OF THE INVENTION

The present invention accomplishes the above-stated objectives as well as others by providing a hingeless assembly for a modular display system. The hingeless assembly is provided with a cross-sectional shape which allows flat panels to be attached thereto and allows for connection to other similarly-shaped hingeless assemblies. The hingeless assemblies provide for lockingly fastening of two panels along a straight line or three panels in a triangular arrangement. Angles in between zero and ninety degrees between adjacent connector panels are also achievable by the present invention.

The hingeless assembly of the present invention comprises an extruded member having a cross-sectional shape which on one side provides for the attachment of flat plates thereto while the other side includes the shapes provided for both locking and rotationally fitting another hingeless assembly extrusion thereto. The display panel attachment section of the extruded shape comprises a plurality of spaced openings, any one of which may be fitted with a flat display panel. The locking and rotational attachment portion of the hingeless assembly includes a circularly-shaped extending portion and a circularly-shaped cup portion extending in a spaced parallel relationship to each other. When the extruded shapes are removably locked to each other, the circular shaped member of the one extrusion fits within the cup portion of the other extrusion while the cup portion of the first extrusion fits around the circular portion of the other extrusion. When assembled for rotation, only one of the circular portions and the cup portions of opposite hingeless assemblies are attached to each other. When one or more panels are joined to each other, a free-standing modular display system is obtained.

Various other objects, advantages and features of the invention will become apparent to those skilled in the art from the following discussion taken in conjunction with the following drawings, in which:

DESCRIPTION OF THE PREFERRED EMBODIMENTS

Figure 1:
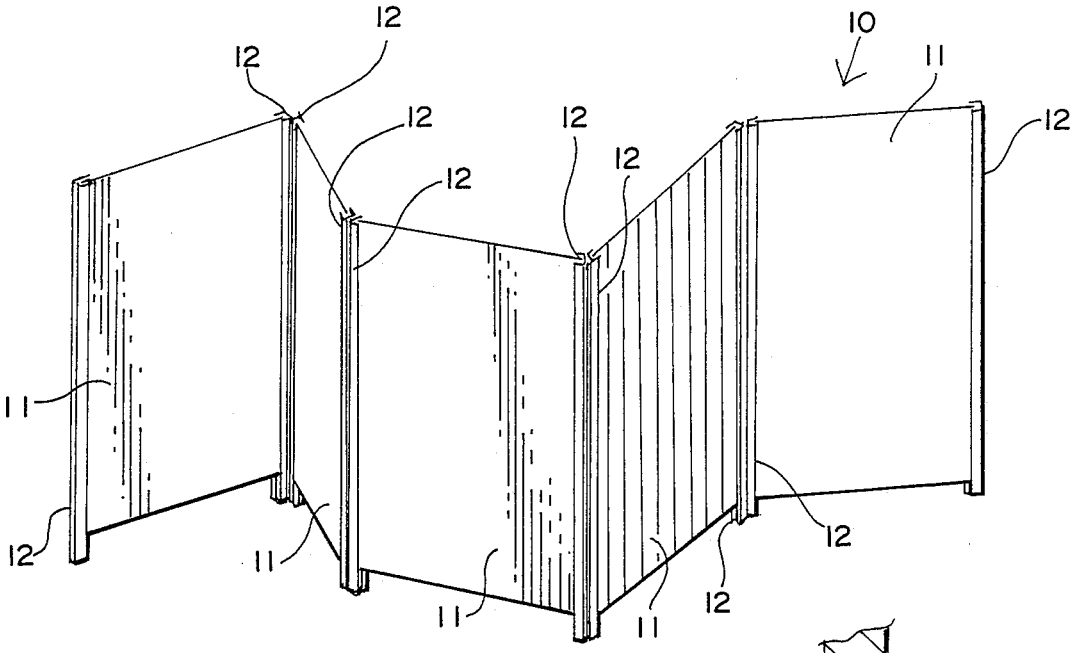
FIG. 1 schematic representation of a typical modular display system to which the present invention may be applied.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings wherein like characteristics and features of the present invention shown in the various figures are designated by the same reference numerals.

Referring now to the various figures of the drawings, there is shown therein a typical modular display system 10 which may be obtained by using the hingeless assembly of the present invention. Such a display system is free-standing and is temporary in nature in that it is easily removable or rearranged. The modular display system 10 includes in the illustrated figure five subsections 11 each comprising a flat display plate 11 and at least one vertical upright post 12. It is to be noted that the display system obtainable with the present hingeless assembly 12 is not restricted to that shown in FIG. 1 of the drawings. A multitude of other shapes or configurations is possible. Such configurations include any angle between zero and ninety degrees between the any two adjoining display panels 11. For example, a box cross section display may be obtained which is joined to a straight display panel assembly. Moreover, the height of the display panels 11 and hingeless assemblies 12 are completely variable in accordance with the design of a particular display arrangement. Thus, virtually any shape of a display arrangement 10 is achievable by the present invention.

Figure 2:
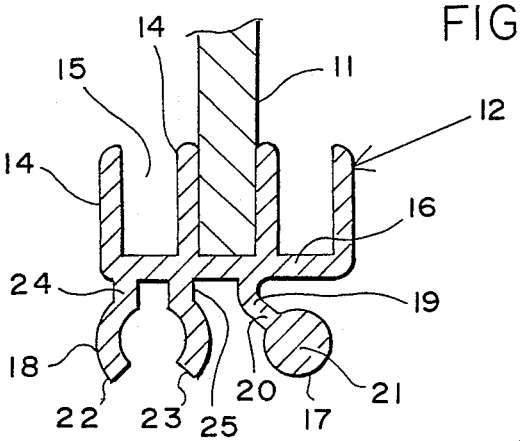
FIG. 2 is a cross-sectional view of the single extruded shape capable of serving as the vertical upright posts of a hingeless modular display system.

The hingeless assembly 12 according to the present invention is shown in cross section in FIG. 2 of the drawings. For convenience, the extruded shape 12 may be considered to comprise two portions: a first portion which allows connection thereto of a flat display panel 13 and a second opposite portion which allows connection thereto of another hingeless assembly 12. The display panel portion includes a number of spaced parallel flanges 14 with a space 15 therebetween. Each of the spaced parallel flange members 14 extend outward from a base plate 16. Each of the parallel extending flange members 14 may be of differing lengths and thicknesses notwithstanding that FIG. 2 shows each of the members 14 of equal length and thickness. Similarly, the spaces 15 between flanges 14 may be of equal width or unequal width.

The hingeless assembly attachment portion of the inventive shape 12 in cross section includes a circular member 17 and a cup-like member 18 which members extend outwardly from base plate 16 and extend the length of the extrusion. Extending member 17 includes a substantially perpendicular extending portion 19 and angled portion 20 and a circular portion 21. The included angle between portion 20 and base plate 16 may be approximately fifty-five degrees. The cup-like extending portion 18 consists of two partial circular extending portions 22 and 23 which are connected to base plate 16 by straight sections 24 and 25 respectively. The internal diameter of cup-like portion 18 is approximately equal to or slightly larger than the outside diameter of circular member 21. However, it is to be observed that the outermost partial circular member 22 is of a greater length than the inner partial circular member 23. The space between the ends of circularly extending members 22 and 23 is slightly less than the outside diameter of ball member 21. In this manner, a respective circular member 21 of another adjoining member 12 may be snap-fitted within the cup-like portion 18 of the reference extruded shape member 12. It is to be noted that the circular member portion 21 and the partial circular shaped portions 22 and 23 are each extended from base plate 16 by an approximately equal distance. This distance is necessary to provide clearance to fit thereunder the adjoining cup-like member 18 or the circular member 17, or both, of the adjoining hingeless assembly 12.

Figure 3:
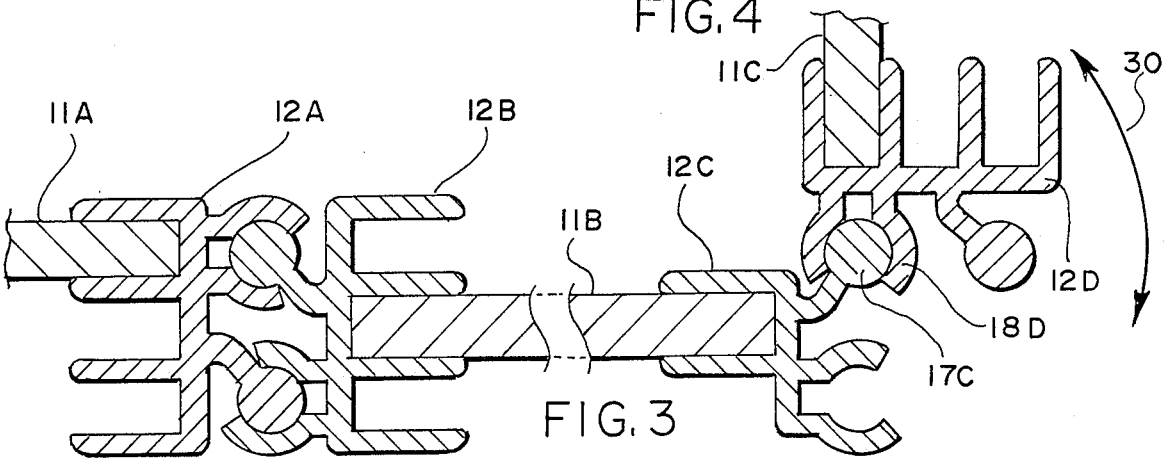
FIG. 3 is a cross-sectional view of a typical display system wherein some panels are arranged in a straight line while other panels are arranged in an angle of between zero and ninety degrees to each other; and, FIG. 4 is a cross-sectional view of three hingeless assemblies joined together in a triangular array with each of the hingeless assemblies being locked to another hingeless assembly.

FIG. 3 depicts in cross section a typical configuration which is achievable by the present hingeless assembly 12. Hingeless assemblies 12A and 12B are snap locked together to form two panel sections 11A and 11B extending in a straight line in a single plane. It is to be noted that each of the cup-like members 18 and the circular members 17 of hingeless assemblies 12A and 12B are snap locked to each other so as to form a rigid connection therebetween. Panel member 11C is illustrated such that it may be positioned at any angle 30 between zero and ninety degrees between panel members 11B and 11C. In this regard, only the circular member 17C is fitted within cup-like member 18D. Since cup-like member 18D is rotatable about circular member 17C, or vice-versa, any angle 30 between zero and ninety degrees is obtainable between panel members 11B and 11C. By joining four panels 11 at ninety degrees to each other as per hingeless assemblies 12C and 12D, a box shaped display panel assembly may be achieved (not shown).

Figure 4:
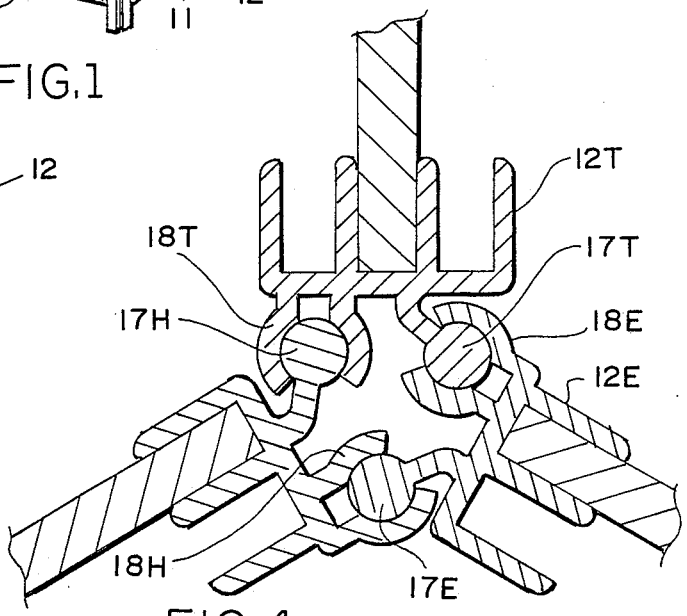

FIG. 4 shows another arrangement which may be obtained between three hingeless assemblies 12E, 12H, and 12I, joined together in a triangular arrangement. In FIG. 4 it may be seen that one of the circular members, for example, 17H is fitted within cup member 18T while cup member 18H is fitted around circular member 17E and, circular member 17T is fitted within cup member 18E. In this manner, a self-standing, completely snapped together, display arrangement is achieved with each of the display panels extending from the center thereof outwardly with an angle of 120° therebetween.

It is to be emphasized that the inventive hingeless assembly 12 may be used to form a display arrangement unlike any of those shown in the figures herein. Accordingly, the present invention is intended to apply not only to the display panel configurations shown in the drawings, but any display panel configuration that is possible by joining two hingeless assemblies together between any angle from zero to ninety degrees therebetween.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. A hingeless connector assembly for joining one or more similar connector assemblies to form a hingeless post assembly for a modular display system, each connector assembly comprising an elongated member having a first connecting means adapted for attachment thereto of a flat panel and a second connecting means for interlockingly attaching up to four adjoining connector assemblies a plate member between said first and second connecting means said second connecting means comprising a cylindrical member having a substantially circular cross-sectional shape and a groove member having a cup-like cross-sectional shape extending outward from the plate of said connector assembly in a parallel manner with a space therebetween, said cylindrical member in cross section comprising a first portion extending substantially perpendicularly from the plate member a second straight portion connected to said first portion with an angle therebetween and a third portion comprising a circularly-shaped member which is connected to the second straight portion thereof.

2. The apparatus of claim 1, wherein said groove member in cross section comprises two extending straight portions each having a curved portion attached thereto and such that a space exists between the inner surfaces of each curved portion.

3. The apparatus of claim 2, wherein said curved portions form an approximate circle having an opening between the ends of said curved portions and an inner diameter approximately equal to the outer diameter of said cylindrical member.

4. The apparatus of claim 3, wherein said opening between the ends of said curved portions is approximately equal to the diameter of said cylindrical member.

5. The apparatus of claim 1, wherein said first connecting means comprises at least one opening between at least two parallel extending members with a space therebetween.

6. A hingeless connector assembly for joining one or more similar connector assemblies to form a hingeless post assembly adapted for a modular display system, each connector assembly comprising an elongated member having a first connecting means adapted for attachment thereto of a flat panel and a second connecting means for interlockingly and rotationally attaching thereto a second connector assembly up to an angle of 90° in either direction a plate member between said first and second connecting means said second connecting means comprising a cylindrical member having a substantially circular cross-sectional shape and a groove member having a cup-like cross-sectional shape extending outward from the plate of said connector assembly in a parallel manner with a space therebetween, said cylindrical member in cross section comprising a first portion extending substantially perpendicularly from the plate member a second straight portion connected to said first portion with an angle therebetween and a third portion comprising a circularly-shaped member which is connected to the second straight portion thereof.

7. The apparatus of claim 6, wherein said groove member in cross section comprises two extending straight portions each having a curved portion attached thereto and such that a space exists between the inner surfaces of each curved portion.

8. The apparatus of claim 7, wherein said curved portions form an approximate circle having an opening between the ends of said curved portions and an inner diameter approximately equal to the outer diameter of said cylindrical member.

9. The apparatus of claim 8, wherein said opening between the ends of said curved portions is approximately equal to the diameter of said cylindrical member.

10. The apparatus of claim 7, wherein said first connecting means comprises at least one opening between at least two parallel extending members with a space therebetween.

* * * * *